US011953301B2

(12) United States Patent
Isaacson et al.

(10) Patent No.: US 11,953,301 B2
(45) Date of Patent: Apr. 9, 2024

(54) MAGAZINE POUCH WITH ELASTIC RETENTION DEVICE

(71) Applicant: Agilite Ergonomics, Ltd., Holon (IL)

(72) Inventors: Elie Isaacson, Givatayim (IL); Lev Israel Friedman, Ramat Gan (IL)

(73) Assignee: Agilite Ergonomics, Ltd., Holon (IL)

( * ) Notice: Subject to any disclaimer, the term of this patent is extended or adjusted under 35 U.S.C. 154(b) by 235 days.

(21) Appl. No.: 17/712,156

(22) Filed: Apr. 3, 2022

(65) Prior Publication Data

US 2023/0314111 A1 Oct. 5, 2023

(51) Int. Cl.
*F42B 39/02* (2006.01)

(52) U.S. Cl.
CPC ..... *F42B 39/02* (2013.01)

(58) Field of Classification Search
CPC .. F42B 39/02; F42B 39/26; A45F 2200/0591; A45F 2005/1013; A45F 3/14; A45F 5/02; A45F 5/021; Y10S 224/931
USPC ..... 224/242, 931
See application file for complete search history.

(56) References Cited

U.S. PATENT DOCUMENTS 9,394,080 B2 * 7/2016 Beck ..... A45C 13/30
10,788,299 B2 * 9/2020 Schandelmeier ..... F42B 39/02

* cited by examiner

*Primary Examiner* — Adam J Waggenspack
(74) *Attorney, Agent, or Firm* — BEHMKE INNOVATION GROUP LLC; James M. Behmke; Andy L. Schofield

(57) ABSTRACT

A magazine accessory includes a magazine pouch including a body having an open end for inserting or removing therethrough a magazine. An elastic retention device is pivotally coupled to the body at a pivot so that the elastic retention device can be positioned over the open end. The elastic retention device is constructed of an elastic cord with a stiffening layer, such that the elastic cord can be pulled over the magazine and press against the magazine to retain the magazine in the body of the magazine pouch. The stiffening layer keeps the elastic retention device pivoted away from the magazine when the elastic retention device is pivoted away from the magazine towards a side of the body.

8 Claims, 3 Drawing Sheets

MAGAZINE POUCH WITH ELASTIC RETENTION DEVICE

FIELD OF THE INVENTION

The present invention relates generally to firearm magazine pouches, and particularly to a magazine pouch with an elastic retention device for placing over a magazine and which can be moved aside so as not to interfere with placing or removing the magazine from the pouch.

BACKGROUND OF THE INVENTION

Ammunition magazine pouches are known which have flaps for retaining a magazine placed in the pouch. Other magazine pouches are known which have shock or bungee cords or retention tabs (all these terms being used interchangeably and also called an elastic retention device) that fit over the magazine and press against it to keep it in place in the pouch.

However, the flap or bungee retention tab obstructs the user from quickly and efficiently grasping the magazine when needed to transfer the magazine from the pouch to an otherwise unloaded weapon or to place a magazine into the pouch. The flap requires two user motions: a first motion to unfasten the flap and a second motion to restrain the flap from continuing to obstruct user access to the magazine contained within the pouch. Likewise, the bungee retention tab interferes with placing or removing the magazine from the pouch and requires the user to use one hand to move the cord or tab out of the way from the top opening of the pouch and use the other hand to place the magazine in the pouch or remove the magazine from the pouch. This is a problem because one must take one's hands off the firearm to do so. In combat circumstances the delay caused by these additional motions and the act of taking one's hands off the firearm can be the difference between life and death for a user.

SUMMARY OF THE INVENTION

The present invention seeks to provide a novel magazine pouch which solves the above problems, as is described more in detail hereinbelow. The magazine pouch of the invention has an elastic retention device for placing over a magazine and which can be moved aside by the act of inserting or removing the magazine, with no need for the user's hand to move the retention device aside, so as not to interfere with placing or removing the magazine from the pouch.

There is provided in accordance with a non-limiting embodiment of the present invention a magazine accessory including a magazine pouch including a body having an open end for inserting or removing therethrough a magazine, and an elastic retention device pivotally coupled to the body at a pivot so that the elastic retention device can be positioned over the open end, the elastic retention device being constructed of an elastic cord with a stiffening layer, such that the elastic cord can be pulled over the magazine and press against the magazine to retain the magazine in the body of the magazine pouch, and the stiffening layer keeps the elastic retention device pivoted away from the magazine when the elastic retention device is pivoted away from the magazine towards a side of the body.

In accordance with a non-limiting embodiment of the present invention the elastic retention device includes a grasping element.

In accordance with a non-limiting embodiment of the present invention the pivot is positioned at a center of the body near the open end.

In accordance with a non-limiting embodiment of the present invention the pivot is formed by loops of the elastic retention device held against the body by one or more straps.

In accordance with a non-limiting embodiment of the present invention the stiffening layer is made of heat shrink tubing.

In accordance with a non-limiting embodiment of the present invention the elastic retention device includes an outer fabric overlay.

In accordance with a non-limiting embodiment of the present invention the grasping element includes a covering.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

Figure 1A:
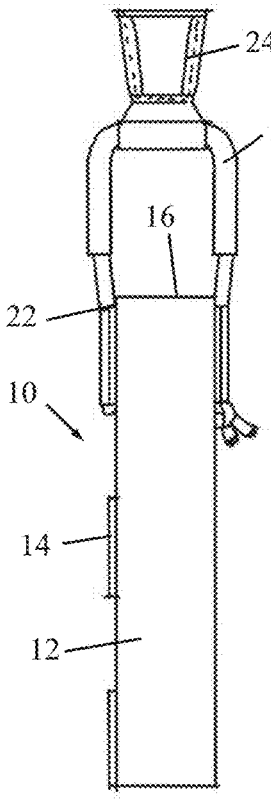
FIGS. 1A and 1B are simplified side-view and perspective illustrations of a magazine pouch, constructed and operative in accordance with a non-limiting embodiment of the present invention.
Figure 1B:
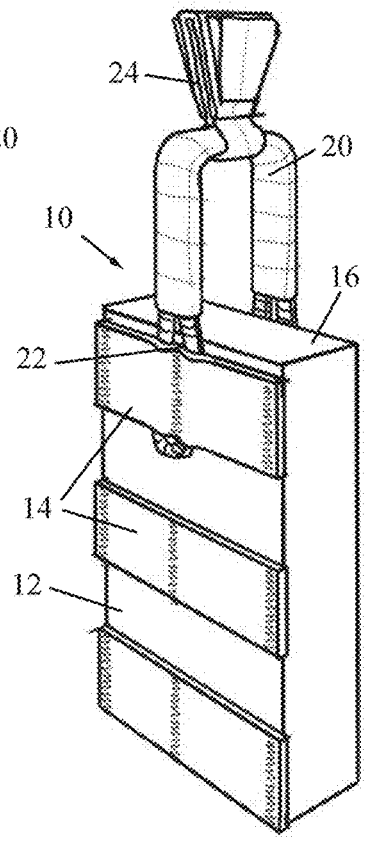
Figure 1C:
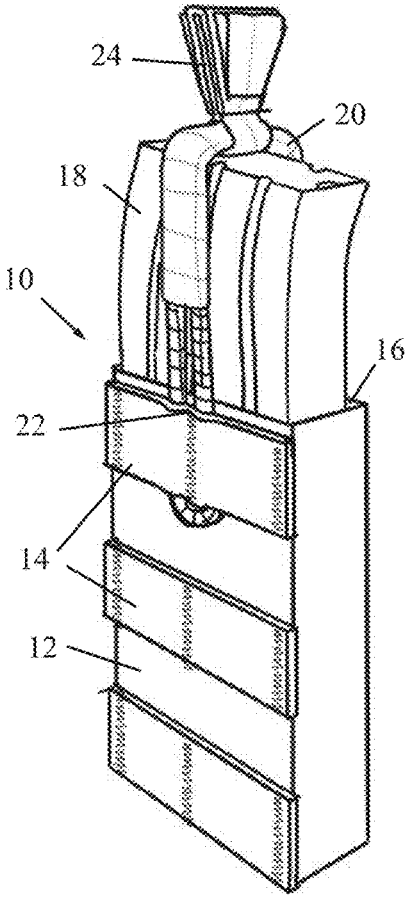
FIG. 1C is a simplified pictorial illustration of the magazine pouch with a magazine inserted therein and retained by an elastic retention device.

Reference is now made to FIGS. 1A-1C, which illustrate a magazine pouch 10, constructed and operative in accordance with an embodiment of the present invention.

The pouch 10 has a body 12 which may be constructed of any suitable elastic material used in the body of elastic magazine pouches, such as but not limited to, elastic nylon weaves, elastic fabrics and many others. The pouch 10 is not limited to a single-pouch configuration, and the invention can be carried out in many configurations, such as but not limited to, double, double stack, triple, etc.

The body 12 may be provided with one or more straps 14 (e.g., with hook-and-loop fasteners or elastic straps, etc.) for retaining the pouch to a belt, vest or other garment. Body 12 has an open end 16 for inserting or removing therethrough a magazine 18 (FIG. 1C).

An elastic retention device 20 is pivotally coupled to body 20 at a pivot 22, typically but not necessarily, positioned at the center of body 12 near open end 16 so that elastic retention device 20 can be positioned over open end 16. The pivot 22 may be formed by loops of the inner material of elastic retention device 20 held against body 12 by one of straps 14, as shown, or by other suitable means. The elastic retention device 20 may be provided with a grasping element (also called pull tab) 24, which may be positioned at the top of elastic retention device 20.

Figure 2:
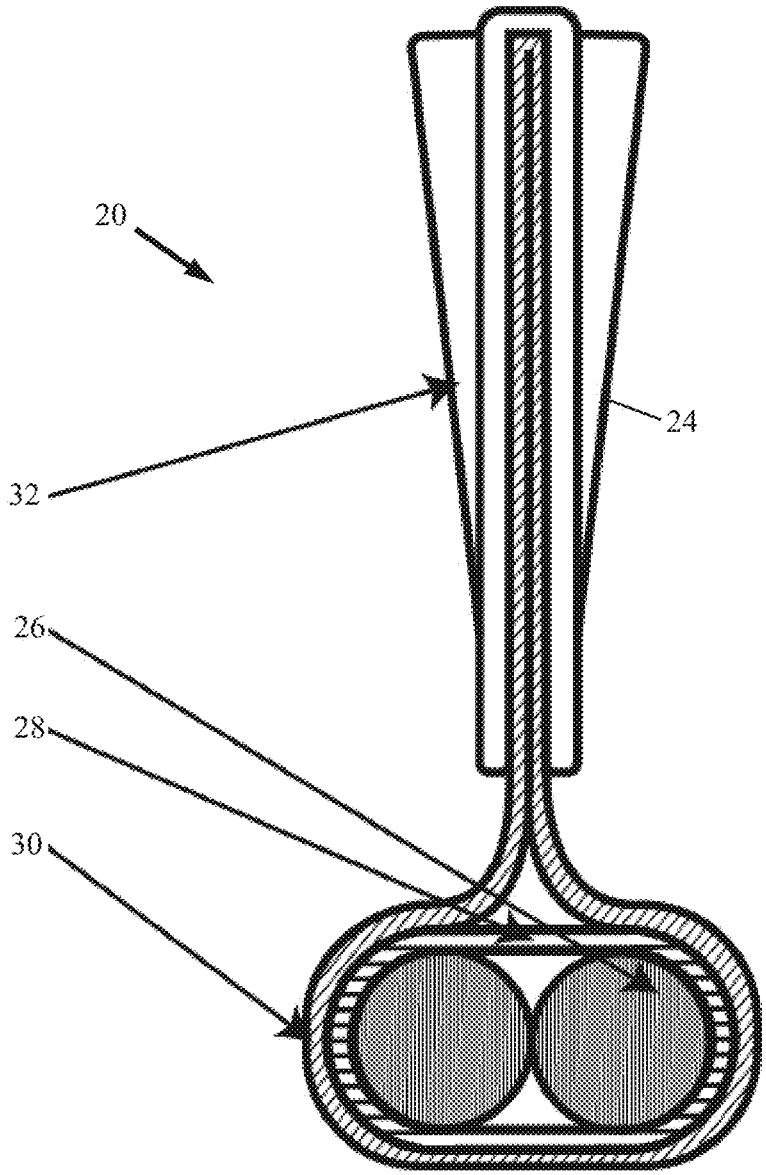
FIG. 2 is a simplified sectional illustration of the elastic retention device.

Reference is now made to FIG. 2, which is a sectional illustration of the elastic retention device 20.

Figure 3:
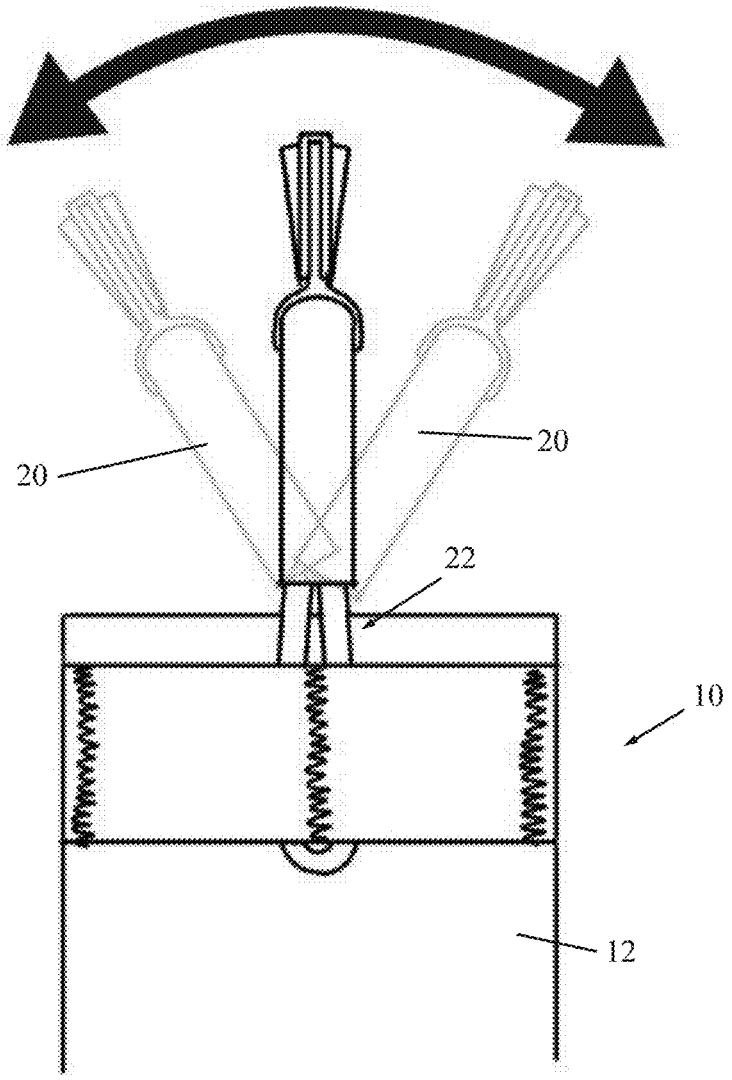
FIG. 3 is a simplified pictorial illustration of pivoting capability of the elastic retention device.

Elastic retention device 20 may be constructed of an elastic cord 26 with a stiffening layer 28. ("Cord" encompasses any slender element.) In a preferred embodiment, the stiffening layer 28 is made of heat shrink tubing which is disposed over cord 26. Alternatively, the stiffening layer 28 may be internal to, or integral with, the elastic cord 26. The elastic cord 26 with the stiffening layer, such as the heat shrink tubing, retains its elasticity so that it can be pulled over the magazine and press against the magazine to retain the magazine in the body of the pouch, while at the same time, the stiffening layer 28 keeps the elastic cord 26 and the entire elastic retention device 20 pivoted away from the magazine when the elastic retention device 20 is pivoted from the center to the side, as seen in FIG. 3. In this manner, the elastic retention device 20 can be placed over the magazine and can be moved aside with just one hand so as not to interfere with placing or removing the magazine from the pouch. The other hand remains on the firearm.

Elastic retention device 20 may include a durable outer fabric overlay 30 (such as but not limited to, CORDURA). The pull tab 24 may be covered with a covering 32, but not limited to, a plastic, e.g., thermoplastic polyurethane (TPU) or polyvinyl chloride (PVC) or other suitable polymer, or natural or synthetic rubber, e.g., EPDM (ethylene propylene diene monomer) or neoprene, or other materials such as nylon webbing or other fabrics or other materials, depending on the application, and may be sewn or molded or otherwise joined to the pull tab 24.

What is claimed is:

1. A magazine accessory comprising:

a magazine pouch comprising a body having an open end for inserting or removing therethrough a magazine; and an elastic retention device pivotally coupled to said body at a pivot so that said elastic retention device can be positioned over said open end, said elastic retention device being constructed of an elastic cord with a stiffening layer, such that said elastic cord can be pulled over the magazine and press against the magazine to retain the magazine in said body of said magazine pouch, and said stiffening layer keeps said elastic retention device pivoted away from the magazine when said elastic retention device is pivoted away from the magazine towards a side of said body.

2. The magazine accessory according to claim 1, wherein said elastic retention device comprises a grasping element.

3. The magazine accessory according to claim 1, wherein said pivot is positioned at a center of said body near said open end.

4. The magazine accessory according to claim 1, wherein said pivot is formed by loops of said elastic retention device held against said body by one or more straps.

5. The magazine accessory according to claim 1, wherein said stiffening layer is made of heat shrink tubing.

6. The magazine accessory according to claim 5, wherein said heat shrink tubing is disposed over said elastic cord.

7. The magazine accessory according to claim 1, wherein said elastic retention device comprises an outer fabric overlay.

8. The magazine accessory according to claim 2, wherein said grasping element comprises a covering.

* * * * *